United States Patent [19]

Ochsner, deceased

[11] Patent Number: 4,535,617

[45] Date of Patent: Aug. 20, 1985

[54] STAMPING MACHINE

[75] Inventor: Arnold Ochsner, deceased, late of Naples, Fla., by Edith Ochsner, Administratrix

[73] Assignee: Forster-Willi Corporation, St. Gallen, Switzerland

[21] Appl. No.: 568,299

[22] Filed: Jan. 5, 1984

[51] Int. Cl.[3] ..... B21D 11/04

[52] U.S. Cl. ..... 72/307; 72/312

[58] Field of Search ..... 72/307, 312, 314, 315, 72/434, 431, 406; 83/218, 277; 74/27, 49, 50

[56] References Cited

U.S. PATENT DOCUMENTS

| | | | |
|---|---|---|---|
| 2,978,160 | 4/1961 | Bunnell | 83/277 |
| 3,430,476 | 3/1969 | Duda | 72/190 |

FOREIGN PATENT DOCUMENTS

| | | | |
|---|---|---|---|
| 120905 | 2/1946 | Australia | 83/218 |
| 1986 | 1/1980 | Japan | 72/190 |

*Primary Examiner*—Lowell A. Larson
*Assistant Examiner*—Robert Showalter
*Attorney, Agent, or Firm*—William V. Pesce

[57] ABSTRACT

A stamping machine composed of a frame supporting a movable carriage having thereon a reciprocal operative punch and die for punching holes in material controllably fed to the die. The carriage movement is controlled by an eccentric mechanism within the confines of two barrier walls which limit the traverse of the carriage. The material is held firm by a clamp during the punching process and released for movement to permit the punch to pull the material a distance equal to the pitch of the stamping cycle, to await the next cycle of stamping.

9 Claims, 9 Drawing Figures

Fig. 7.
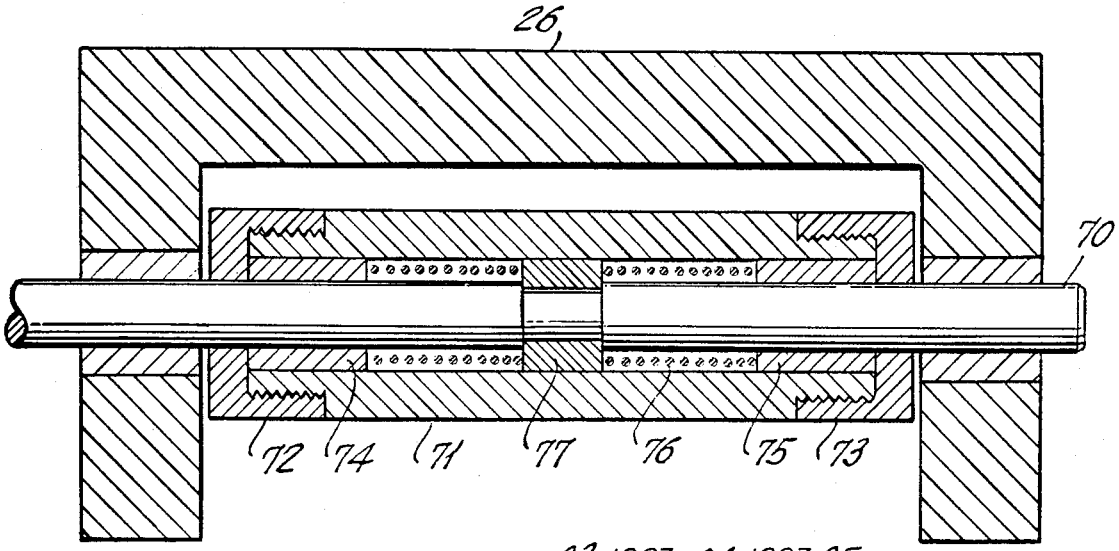
Fig. 9.
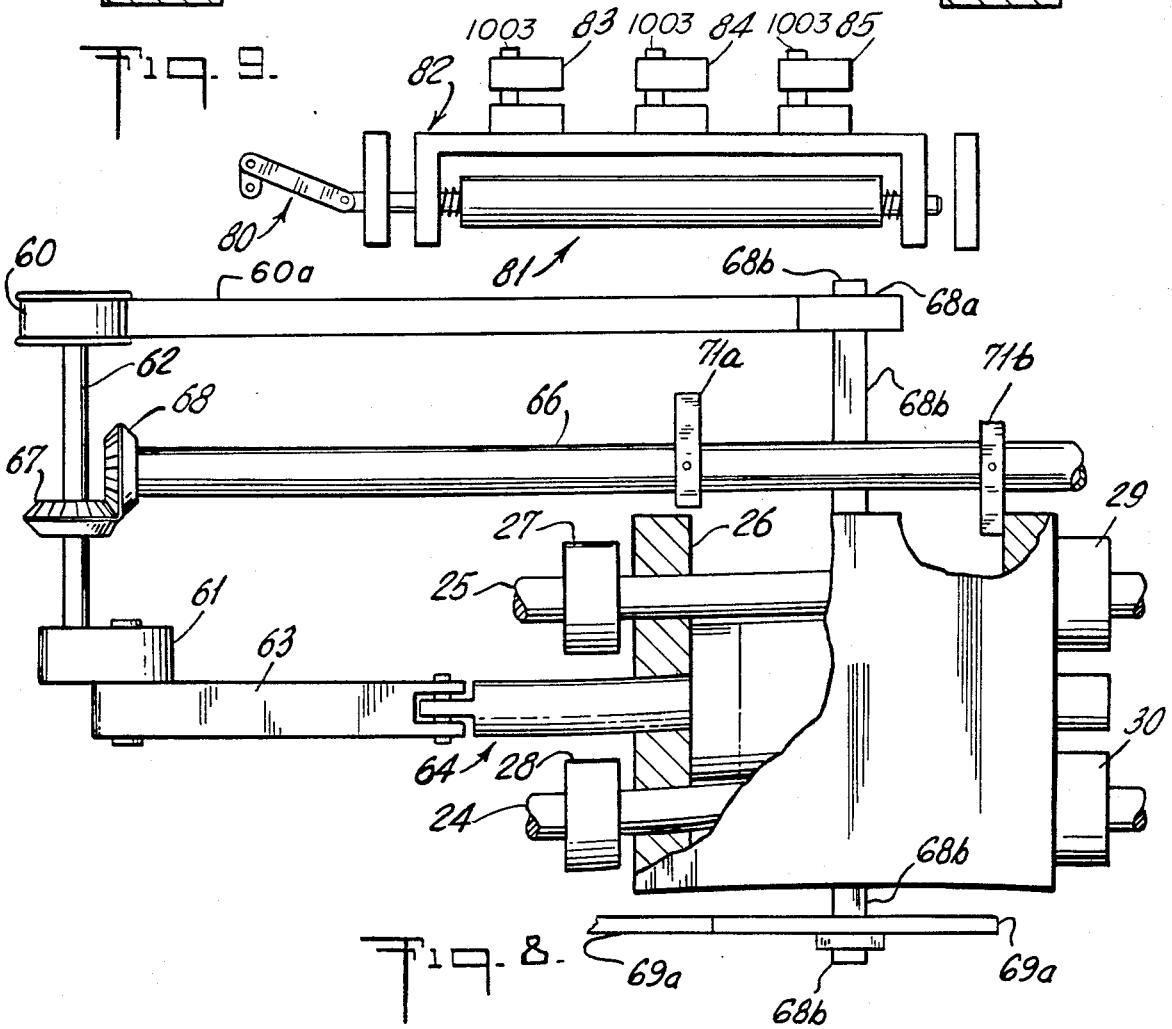
Fig. 8.

STAMPING MACHINE

This invention relates to a stamping machine and in particular is directed to a stamping machine devoid of material feeding accessories, stamping and/or forming dies and material piloting devices, while yet achieving high production speeds and accuracy in pitch, form and quality.

BACKGROUND OF THE INVENTION

Conventional stamping machines use hitch type feeds which advance the material to be stamped and/or formed through one or a series of dies mounted in a stamping press, the finished product then being collected after discharge from the stamping operation after being acted upon by the die or dies. Generally, the stamping press hits in a repetitive up-down motion, closing and opening the die in one positive movement every short fraction of the stamping press cycle, the material then, with the *die open*, being advanced one pitch into its next dormant position, ready to receive the next *closing and opening* sequence of the die by the said roll or hitch feeding machine. Some such devices have been described in a variety of patents such as (1) U.S. Pat. No. 3,180,294 (Daalderop), (2) U.S. Pat. No. 3,470,726 (Richter) and Australian Pat. No. 120,905 (Kretz).

These material feeding mechanisms fail to hold the material to be stamped accurately within the die, so that the pitch, from one stamping to the next, cannot hold a consistent specified dimension. To achieve accuracy of pitch, dies have been equipped with pilots which are expensive, difficult to maintain, slow production and reduce efficiency of operation.

The invention contemplated herein departs radically from the conventional by replacing any material feeding mechanism by utilizing the die itself, after closing and penetrating the material, to advance to the next position, carrying the material forward, thus opening and freeing the material. The die thereafter returns to its original starting position to start the next stamping operation or cycle. Hence, in place of a die being in a fixed position operated by an attachment to an up-down motion of a conventional stamping machine, the die being closed and opened without interruption in a short fraction of the cycle (stroke) of the stamping press, there is instead a die unattached to the operating stroke of the stamping press. Actually, the die is mounted on a carriage which in-line travels back and forth and carries with it the punch through the facility of punch and die assembly a measured distance for the desired pitch, and which otherwise closes at one end and opens at the other end of the carriage travel. In place of permanent attachment of die to stroke of the stamping press, an intermittent is used, operative only at each end of the carriage travel; the cycle (stroke) of the stamping press for the die to dwell in its closed position in one direction, and in its open position in the other direction, of its back and forth motion.

SUMMARY OF THE INVENTION

It is therefore a principle object of the invention to provide an improved type stamping machine.

Another object of the invention is to provide a stamping machine which obviates the need for roll, hitch or other material feeding device or aids.

Another object of the invention is to obviate the need for piloted dies, guides or other expensive control devices or apparatus for controlling pitch or dimensional advances of said dies.

A still further object of the invention is to provide a stamping machine which can run at very high speeds and considerable accuracy; is simple and economical to operate; is rugged, durable and contains relatively fewer moving parts to maintain and adjust.

Various further and more specific purposes, features and advantages will clearly appear from a detailed description to be given below when taken in connection with the accompanying drawings which form part of this specification and illustrate merely by way of example embodiments of the invention. In the following description, parts will be identified by the same reference numeral where they are similar and perform the same function, as shown in the several figures of the drawings,

BRIEF DESCRIPTION OF THE DRAWINGS

FIG. 7 shows a sectional view of the carriage and carriage impellor according to the invention.

FIG. 8 shows a partial top view of the stamping machine and the drive for imparting motion to the carriage mechanism.

FIG. 9 shows schematically a system for mounting multiple dies on a single carriage.

DETAILED DESCRIPTION OF THE DRAWINGS

Figure 1:
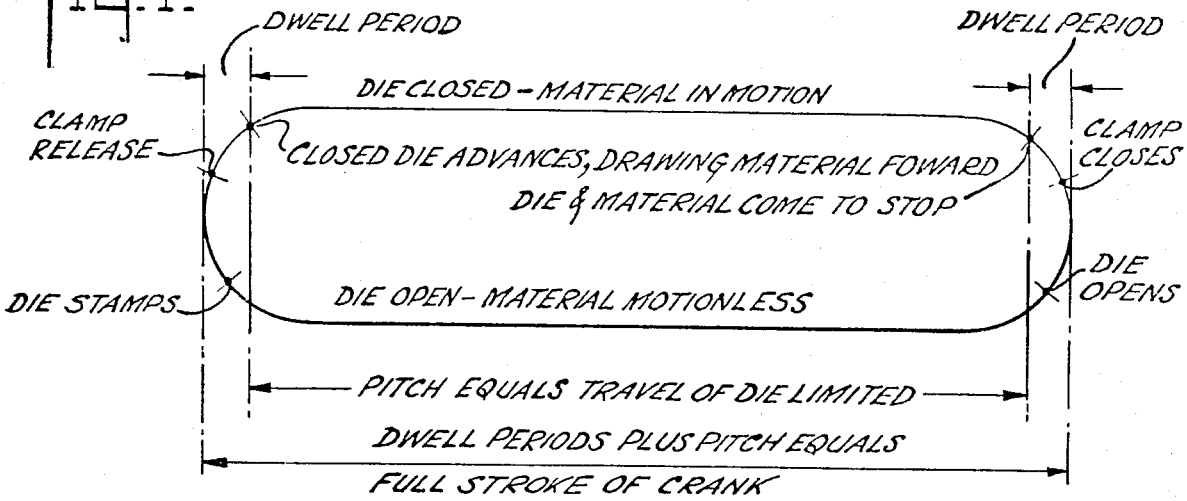
FIG. 1 is a cyclic diagram of the motions the machine undergoes according to the invention.
Figure 2:
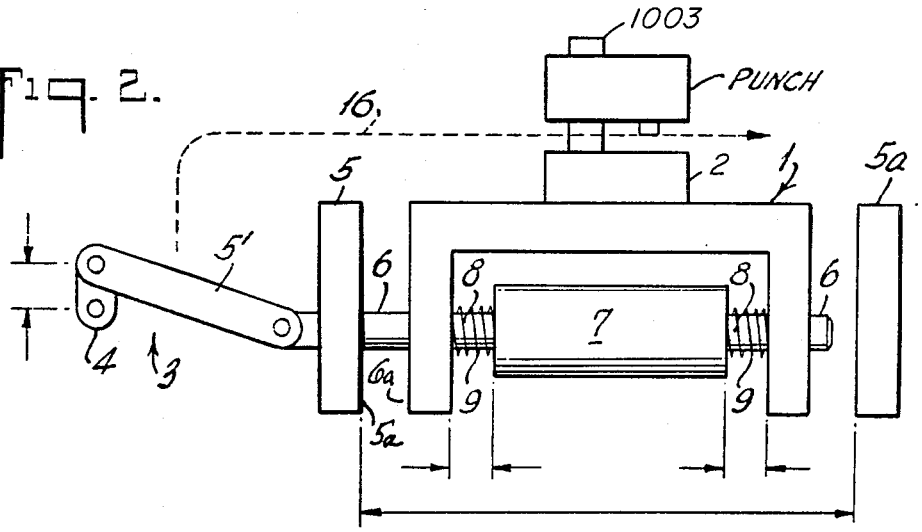
FIG. 2 shows a diagram of the die and carriage mechanism and the method of carrying out the movements thereof according to the invention.
Figure 3:
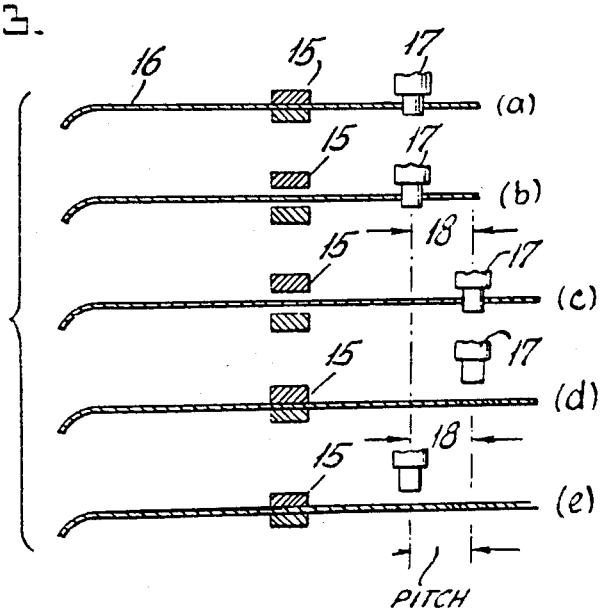
FIG. 3 shows a diagram of the sequence of die, clamp and material movements according to the invention.

Referring now in more detail to the drawings illustrating preferred embodiments by which the invention may be realized, there is shown in FIGS. 1–3 diagrams illustrating the principles of the invention which comprises a carriage 1 bearing die 2 and reciprocated by a crank arrangement 3, motor driven, the hub of which is equipped with an eccentric 4 which dimensionally provides for the desired pitch plus a dwell period at each end of the carriage travel. The dwell period is timed to the dwell provided by the stamping components of the machine. To positively halt and hold the die (carriage) in place so that it may perform its functions while the material to be worked is and remains firmly fixed in position, heavy blocks 5 and **5*a* are affixed to the rails 6 on which said carriage travels. The carriage travels within the limits of these blocks upon its back and forth movement. This dimension, adjustable, is the desired pitch dimension and must never exceed the full stroke of the crank less a certain minimum dimension providing for the necessary dwell periods utilized by the die performing its function properly. This arrangement actually causes the carriage to impact with a block at each end of its back and forth movement. This means that the accuracy of the pitch is established by the carriage being brought firmly and positively into contact with the blocks, the distance therebetween being called the pitch. The carriage 1 approaches the block 5 at the end of the stroke period at a reduced speed so that after contact is made the carriage changes direction. Hence at the point of contact the carriage reaches zero speed so that at contact the noise level should be minimal. It is also possible to reduce noise at the point of contact by coating the block and carrier at their interfacing surfaces 5***a*, 6*a* with material designed to reduce noise to low tolerable levels.

A crank 5', attached to the eccentric 4, imparts reciprocating motion to the carriage by means of an impellor 7 which consists of a push rod 8 equipped at both ends (designed to function in each direction of the carriage travel) with buffer springs 9. These springs are sufficiently stiff to propel the carriage into contact with the blocks 5*a* and 5. After actual contact takes place, the continuing stroke of the crank causes the spring to compress, trapping the carriage between it and the block with growing power, until the rotation of the crank reverses the direction of the impellor rod. At this point is must be noted that the carriage (die) is in the dwell period and motionless, until the carriage is brought into its reverse motion by the spring at the opposite end of the impellor rod by the crank eccentric as the first spring loses contact with the carriage. These springs also act as dampeners, lessening the shock of the impact referred to herein.

The linear speed of the crank-operated impellor 7 is not constant, but diminishes as the crank approaches the end of its stroke to give speed linearly at that exact point where it reverses direction, then accelerates to top speed at the high point of its eccentric, to diminish this speed to a stop at the point in rotation where it must again reverse direction. This speed factor is exploited by locating the dwell period at each end of the carriage back and forth movement; just before and just after reversal of travel when linear speed of movement is very low or zero a stop in the period of time when the various activities required by this system are performed, as shown specifically in FIG. 1 which depicts the time-movement diagram of the system. Moving toward the stop point, the impact of the carriage, propelled by the shock-absorbing spring-equipped impellor, is low in force against the limiting block. This applies at both ends of the carriage reciprocating action. Specifically with regards to FIGS. 1 and 3 and following the motion of the rotating crank, the die is open (a), on carriage, returning from its mission of delivering stamped material to the discharge point, carriage collides with limiting block and comes to complete stop, clamped in place, as crank proceeds onward to point of reversal of direction; at point of reversal stamping action takes place and punch penetrates material; clamp keeping material in position releases; carriage resumes movement in reverse direction as impellor picks it up, the die remaining closed with its punch through the material acting as a positive clamp, and travels to point of impact and halted; material clamp closed, to lock material securely in position; die opens, compelting the stamping operation and freeing itself from the material; carriage reverses direction with die open, and the entire sequence of activity repeats itself.

Although FIG. 1 shows the timing sequence as a function of the eccentric, FIG. 3 shows physically how the operation may be observed. In (a) the clamp 15 is closed on material 16 and the die stamp 17 has stamped the material. Thereafter, shown at (b), the clamp 15 opens and the die stamp 17 still remains within the material. At (c) the stamp still within the material transports the material, the extent of the pitch movement 18 of the carriage to which it is attached. Thereafter, as at (4), the clamp 15 closes and the stamp lifts off the material, the clamp holding the material firmly in place. Then, as at (e), the stamp is carried back to the extent of the pitch 18 movement of the carriage in the reverse direction from the place of beginning to complete the cycle.

A novel feature of the stamping press is the incorporation of the clamping device operated by the stamping component assembly to assure positive timing. This device clamps the material being processed firmly in position except from the moment the die has penetrated the material at which time it assumes the role of the clamp before it (the die) resumes motion. The die draws the material to the discharge end of the production cycle, to the position in time when the die is halted by the pitch block, at this point the clamp closes before the die opens to release the material. Thus the die may return to its starting position without affecting the positioned material; this procedure guarantees that the material is always clamped tight, by the die closed, by the die and the clamps closed, or the clamp closed. Freedom to move is never accorded the material at any time during the production cycle. Hence, one of the reasons for the high accuracy is the stamping process.

Figure 4:
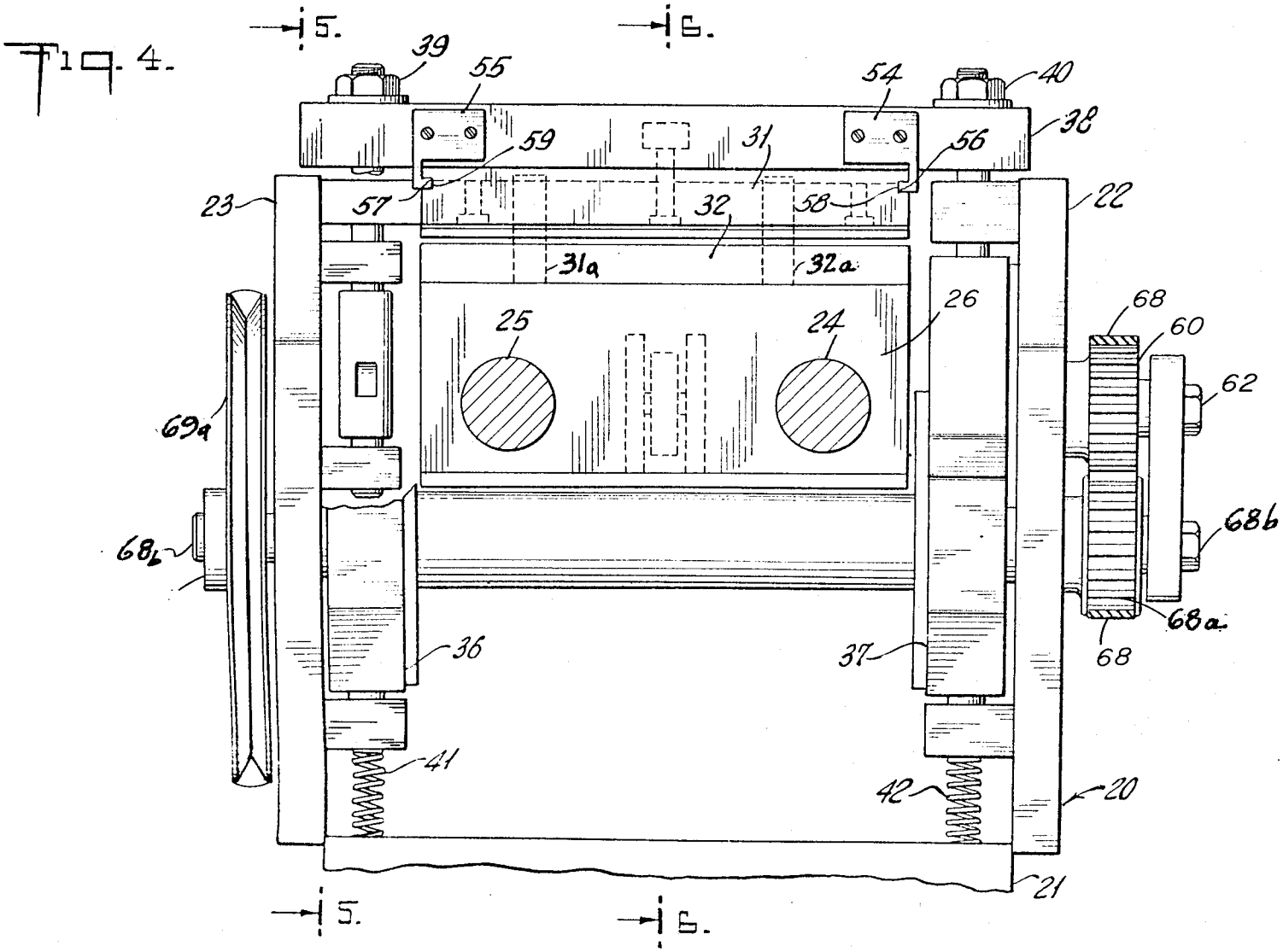
FIG. 4 shows an end view of the stamping machine according to the invention.
Figure 5:
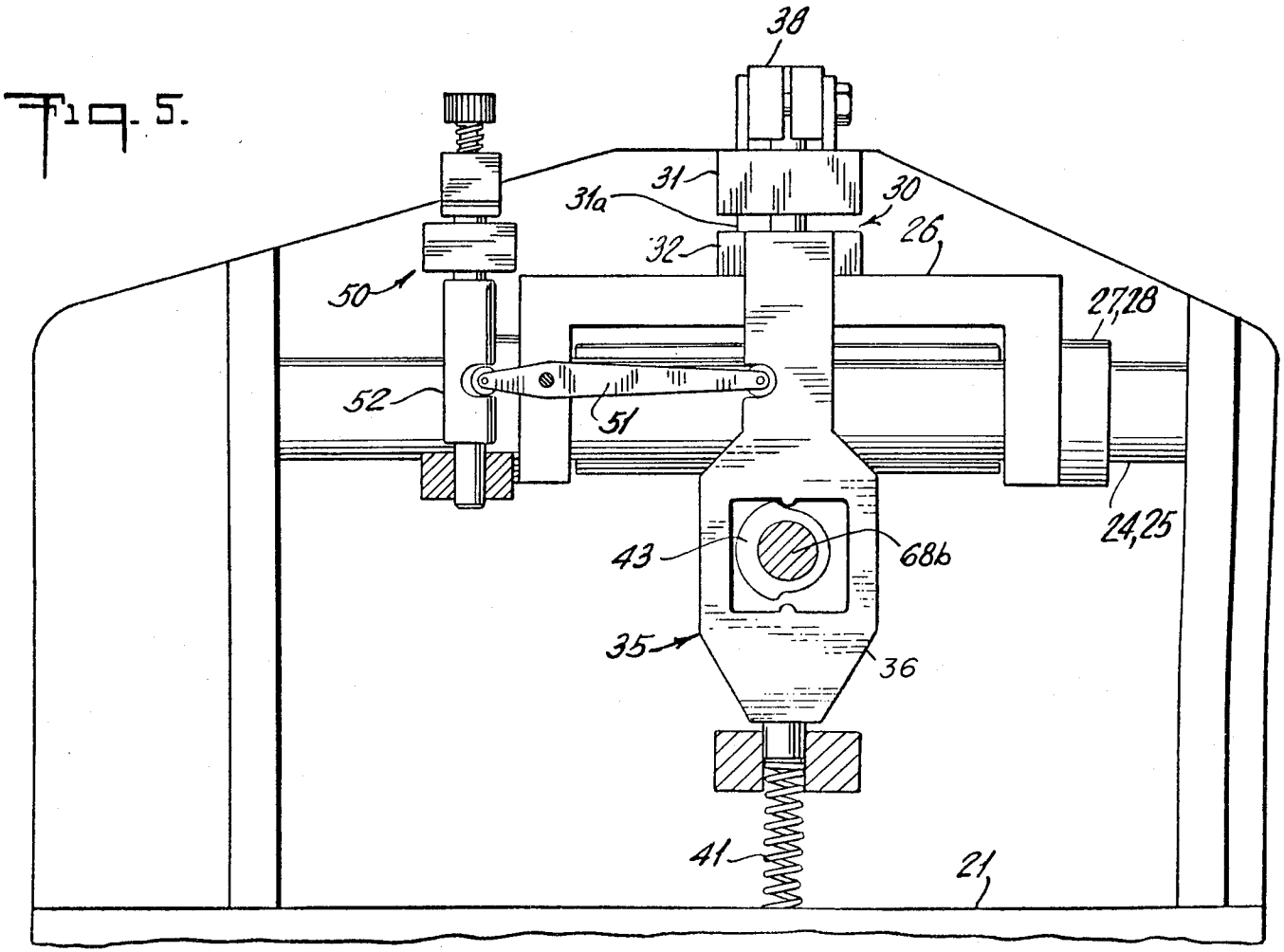
FIG. 5 shows a side sectional view of the stamping machine through the Line 5—5 of FIG. 4.
Figure 6:
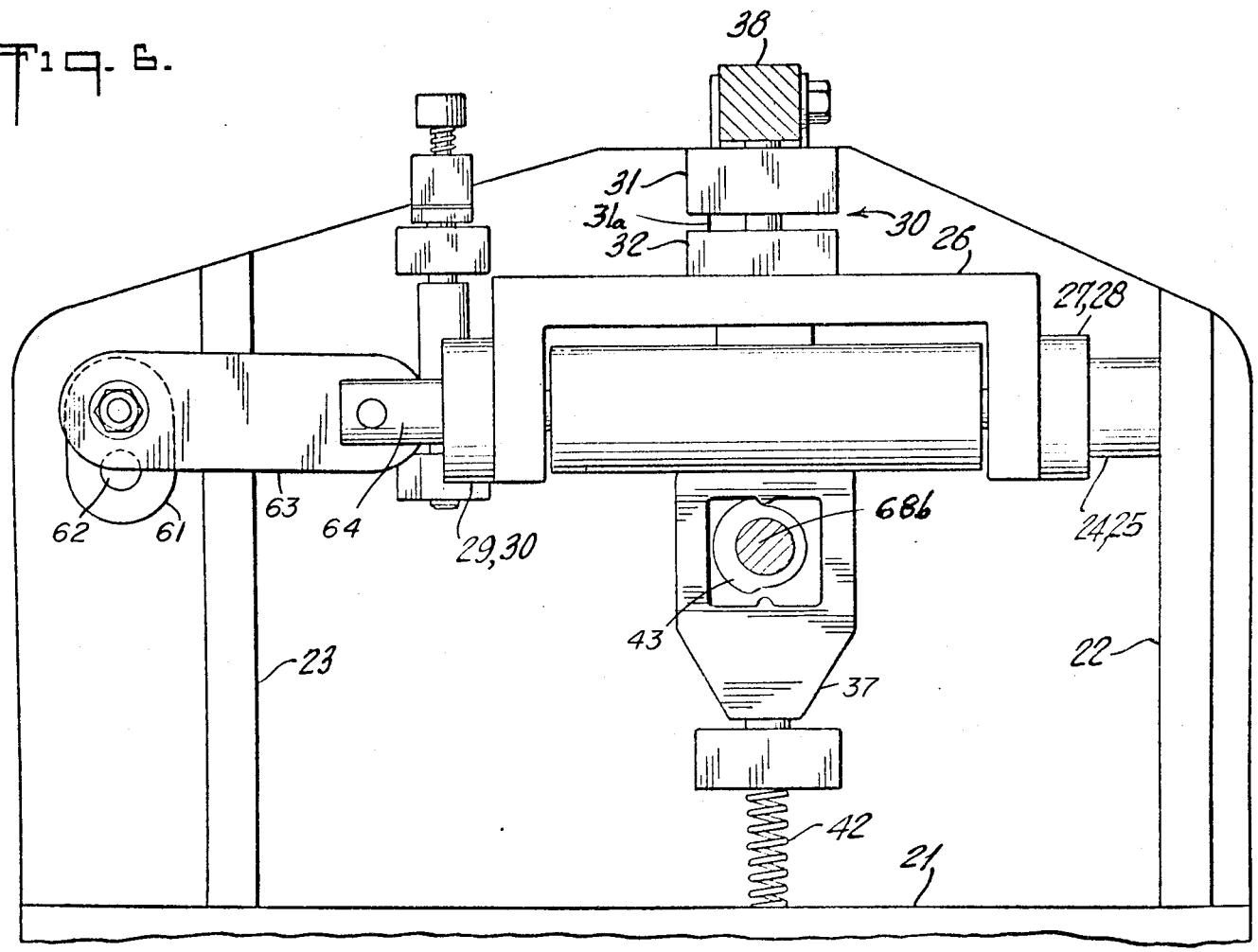
FIG. 6 shows a side sectional view of the stamping machine through the line 6—6 of FIG. 4.

The foregoing describes in principle the workings of the machine and the various functions throughout a cycle of operation. Now describing in detail a particular machine embodying these principles and the manner of carrying them out, there is shown in FIGS. 4, 5 and 6 various views of such a machine, said machine in particular comprising a frame 20 mounted to a base 21 and having side walls 22 and 23, each fixedly supporting a pair of spaced-apart support rods 24 and 25. Intermediate said walls is positioned a channel-shaped carriage mechanism 26 slidably supported by said pair of spaced-apart support rods and having freedom of longitudinal movement along said support rods. Mounted to said support rods and bridging said carriage are pairs of retaining rings 27, 28 and 29, 30 each pair being fixedly mounted to the support rods and spanning the carriage mechanism. The spacing of each bridging pair 27, 29 and 28, 30 less the length of the well portion of the channel-shaped carriage constitutes the pitch or travel of the carriage when undergoing its cyclic movements. The facing of the retaining rings represent the barrier or retaining wall against which the carriage impinges, as discussed previously with respect to the operating principles of the invention.

Mounted atop the carriage mechanism 26 is stamping die apparatus 30 consisting of punch 31 and die 32, each disposed to ride with the carriage during its cyclic movements as a unit or combination thru the facility of slide posts 31*a* and 32*a*. The punch portion of the stamp die apparatus is activated by the operation of stamping post mechanism 35. The stamping post mechanism comprising a pair of vertically positioned stamping parts 36 and 37, each stradling the carriage mechanism 26 and bridged by a support bar 38 to which it is attached by nuts 39 and 40 at the upper extremeties thereof. The lower extremities of said stamping posts are supported by coil springs 41 and 42 which are in turn attached to the base 21. The stamping post is driven in a vertical direction by a cam mechanism 43 so disposed as to provide the cyclic variation previously described with respect to the time sequence of the various functions. In other words, the cam is so designed as to assure the opening and closing of the punch at the proper time during the sequence of operations of the various units making up the machine. The cam is designed to have dwell periods in timed relationship to each end of the crank stroke and is suitably driven by a belt 60*a* or other linkage mechanism to the driving mechanism 60*b* powering the eccentric.

A clamping mechanism 50 for suitably and reliably clamping the material to be stamped is shown in said FIGS. 4 and 5 and is controlled by a linkage device 51 which has an extremity thereof connected to a clamping post 52 and the other extremity connected to the stamping post 35, both extremities having rotable rollers attached thereto for positively engaging both the stamping and clamping posts. The linkage is pivotally mounted to the frame and is made operable by the controlled time operation of the stamping posts.

The movements of the stamping die apparatus atop the carriage is further made feasible by the use of hangers 54 and 55 connected to bridging bar 38. The punch portion 31 of the stamping mechanism has elongated grooves 56 and 57 along which the hook portions 58, 59 are free to ride. The lifting of the punch from the die or material is accomplished by the hangers which are in turn connected to the bridging bar which is in turn connected to and actuated by the stamping posts. The movement of the punch and die with the carriage permits the punch portion to slide or move relative to the hangers the length of the pitch movement previously mentioned. Thus the punch and die are permitted freedom of movement with the carriage in a horizontal direction while the stamping or bridging-bar remains free to move only in the vertical direction and not horizontally. As previously stated the punch and die move together on the carriage as a unit through the facility of the slidable posts 31*a*, 31*b*. The posts are fixedly attached to the base or die and the punch slidably moves vertically with respect to such posts. This is schematically shown in FIG. 2 and again in FIG. 9.

FIG. 8 shows a system for preventing rebound, to prevent the carriage mechanism from bouncing off the retaining walls when impact takes place and thereby interfering with the accurate positioning of the die and/or material. The system comprises a pulley 60 belt-driven by a belt 68 and shaft connected to an eccentric 61 via shaft 62. The eccentric 61 is coupled to a crank 63 link-connected to an impellor assembly 64 which is in turn connected to carriage 26 previously described. The power drive permits the carriage to undergo reciprocal action, also previously described. Also linked to the power drive assembly is shaft 66 via a pair of beveled gears 67, 68 which in turn activate a pair of eccentrically connected and spaced apart latches 71*a*, 71*b*, each of which is disposed to engage and retain the impellor against the retaining wall after each collision or impact therewith. In other words, after impact by the carriage with the retaining wall, latch 71*a* rotates in a direction which blocks carriage 26 from moving, and similarly the other latch 71*b* when the carriage moves in the other direction performs the same function. Both latches are phased 180 degrees apart to effect the proper function. The pulley 60 as stated is drawn by a belt 68 which is connected to pulley wheel 68*a* connected to shaft 68*b*. The shaft 68*b* is driven by a relatively, large pulley wheel 69*a* which is belt connected via belt 69*a* to an external motor or power source not shown. Also connected to shaft 68*b* and driven thereby are the stamping post mechanism 35.

One form of impellor assembly driven by the eccentric is shown in FIG. 7 and comprises an impellor rod 70 surrounded by a barrel 71 externally threaded at both extremities and threadably engaged by a pair of internally threaded end caps 72 and 73. Intermediate said impellor rod and barrel in proximity to said end caps are a pair of support bearings 74, 75, for substantially completing the impellor assembly, with the exception of a split-collar insert 76. The impellor assembly, as shown, with its springs reciprocates slightly within the limits imposed by the inside surfaces of the carriage so that as one sping compresses to force carriage wall against pitch limit in one direction, the other can exert its pressure only on the other inner surface of said carriage.

FIG. 9 shows schematically a system for mounting multiple dies on a single carriage and in general comprises an eccentric drive 80 connected to an impellor assembly 81 which imparts reciprocal motion to a carriage 82 upon which there is attached and movable therewith a plurality of dies 83, 84 and 85 which typically are used for blanking, stamping and forming respectively. Thus by the use of such multiple or different purpose dies different functions may be performed on the same material or part being made. Hence, perfect registry in pitch is achieved of all the operations on materials being fabricated.

While the invention has been described and illustrated with respect to a certain particular preferred embodiment which gives satisfactory results, it will be understood by those skilled in the art, after understanding the principle of the invention that various changes and modifications may be made without departing from the spirit and scope of the invention and it is intended therefore in the appended claims to cover all such changes and modifications.

Having defined the invention, what is claimed is:

1. A material stamping machine comprising (a) a support frame, (b) a reciprocally movable carriage supported by said frame, (c) barrier walls having interfaces and restricting the reciprocal movements of said carriage, (d) one or more punch and die apparatus carried by said carriage, (e) power driving means including an eccentric for reciprocally actuating said carriage against the interface of the barrier walls in a pre-determined time sequence, (f) restraining means connected to said power means and disposed to engage the carriage after wall contact to restrict the movements thereof, (g) stamping means responsive to said eccentric power means for actuating said punch according to said predetermined time sequence, and (h) material clamping means responsive to the actuations of said stamping means for clamping and releasing material in the timed sequence.

2. A stamping machine according to claim 1 and wherein said reciprocal eccentric power means includes a link connected eccentric attached to said carriage via spring connected means and disposed to produce dwell time periods at both extremes of reciprocal cycle.

3. A stamping machine according to claim 2 and wherein said spring connected means includes an impellor rod assembly connected to said carriage with resilient means at both extremes each disposed to permit the eccentric and linkage to proceed for a time beyond the point of impact between said carriage and wall.

4. A stamping machine according to claim 3 and wherein said resilient means includes coil springs surrounding said impellor rod assembly.

5. A stamping machine according to claim 1 and wherein said power driving means includes shaft connected means driven thereby and having spaced-apart cam-like latches attached thereto in radially opposed phased relationship and each disposed to engage the carriage mechanism at opposing ends of its reciprocal travel after each wall impingement to prevent wall bounce.

6. A stamping machine according to claim 1 and wherein said punch and die apparatus means includes a punch disposed to engage the material during stamping and to thereafter move the material while so engaged a distance determined by the movement of the carriage and its impingement of the wall barrier.

7. A stamping machine according to claim 1 and wherein said carriage supported punch and die apparatus includes a plurality of punch and dies, each disposed to operate upon the same material to produce different configurations.

8. A stamping machine according to claim 1 and wherein said clamping means includes linkage means connected to said stamping means for actuating said clamp in said times sequence.

9. A stamping machine according to claim 1 and wherein said interface of carriage and barrier walls includes material coating means thereon to minimize the levels of noise upon contacts of said carrier and walls.

* * * * *